US008587210B2

(12) United States Patent
Gerber et al.

(10) Patent No.: US 8,587,210 B2
(45) Date of Patent: Nov. 19, 2013

(54) ELECTRONIC BALLAST FOR OPERATING AT LEAST ONE DISCHARGE LAMP

(75) Inventors: Maximilian Gerber, Munich (DE); Wolfram Sowa, Munich (DE); Arwed Storm, Dachau (DE)

(73) Assignee: Osram AG, Munich (DE)

( * ) Notice: Subject to any disclaimer, the term of this patent is extended or adjusted under 35 U.S.C. 154(b) by 111 days.

(21) Appl. No.: 13/382,301

(22) PCT Filed: Jun. 21, 2010

(86) PCT No.: PCT/EP2010/058685
§ 371 (c)(1),
(2), (4) Date: Jan. 5, 2012

(87) PCT Pub. No.: WO2011/012373
PCT Pub. Date: Feb. 3, 2011

(65) Prior Publication Data

US 2012/0112653 A1 May 10, 2012

(30) Foreign Application Priority Data

Jul. 30, 2009 (DE) ..... 10 2009 035 371

(51) Int. Cl.
*H05B 41/36* (2006.01)

(52) U.S. Cl.
USPC ..... 315/224; 315/219; 315/244

(58) Field of Classification Search
None
See application file for complete search history.

(56) References Cited

U.S. PATENT DOCUMENTS

| | | | | |
|---|---|---|---|---|
| 5,740,021 | A | 4/1998 | Lecheler et al. | |
| 6,784,626 | B2 * | 8/2004 | Otake et al. | 315/291 |
| 2005/0088109 | A1 | 4/2005 | Storm | |
| 2005/0218828 | A1 | 10/2005 | Busse et al. | |
| 2009/0302773 | A1 | 12/2009 | Fischer et al. | |

FOREIGN PATENT DOCUMENTS

| | | | |
|---|---|---|---|
| DE | 102005018795 | A1 | 10/2006 |
| EP | 0763276 | B1 | 8/2001 |
| JP | 97778 | A | 1/1997 |
| JP | 200423825 | A | 1/2004 |
| JP | 2004357493 | A | 12/2004 |
| JP | 2009124866 | A | 6/2009 |
| WO | 2007096263 | A1 | 8/2007 |

OTHER PUBLICATIONS

English language abstract of JP 2004-357493 A dated Dec. 16, 2004.
English language abstract of JP 2004-023825 A dated Jan. 22, 2004.
English language abstract of JP 2009-124866 A dated Jun. 4, 2009.
English language abstract of JP H097778 A dated Jan. 10, 1997.

* cited by examiner

*Primary Examiner* — Crystal L Hammond

(57) ABSTRACT

An electronic ballast for operating at least one discharge lamp may include an input having a first and a second input connection for coupling to a DC supply voltage; a load circuit having an output; a constant-current transformer which includes a converter throttle, a converter diode and a converter switch, whereby the converter throttle is coupled serially between the first input connection and the load circuit; an activation circuit which is configured to activate the converter switch during operation with an HF signal; wherein at least one component across which a second voltage which is opposite in phase to the first voltage drops during operation is coupled between the internal and the external reference potential.

13 Claims, 2 Drawing Sheets

ELECTRONIC BALLAST FOR OPERATING AT LEAST ONE DISCHARGE LAMP

RELATED APPLICATIONS

The present application is a national stage entry according to 35 U.S.C. §371 of PCT application No.: PCT/EP2010/058685 filed on Jun. 21, 2010, which claims priority from German application No.: 10 2009 035 371.2 filed on Jul. 30, 2009.

TECHNICAL FIELD

This disclosure relates to an electronic ballast for operating at least one discharge lamp having an input having a first and a second input connection for coupling to a DC supply voltage, whereby the second input connection is connected to an external reference potential; to a load circuit having an output having a first and a second output connection for connecting the at least one discharge lamp; to a constant-current transformer which includes a converter throttle, a converter diode and a converter switch, whereby the converter throttle is coupled serially between the first input connection and the load circuit; an activation circuit which is configured to activate the converter switch during operation with an HF signal, whereby a first capacitance is defined by the regions of the electronic ballast which are connected during operation to an HF voltage, by means of which a first voltage is defined which during operation drops with respect to the external reference potential across the first capacitance, and whereby a second capacitance is defined by the regions of the electronic ballast which during operation are supplied with a DC voltage HF-wise with respect to an internal reference potential.

BACKGROUND

In such electronic ballasts, voltages of several 100 V having frequencies of approx. 30 kHz to 1 MHz are switched by means of the constant-current transformers. In this situation, constant-current transformers are converters wherein current is taken from or alternatively fed back into the supply voltage during each operation cycle. Two important representatives are the buck converter and the boost converter. Such converters include a converter throttle, a converter diode and a converter switch, whereby the converter throttle is coupled serially between the first input connection and the load circuit. With regard to the high-frequency switching of high voltages described above, both conducted and also emitted electromagnetic interference are produced, which must lie beneath the limit values of the relevant EMC regulations. A distinction is made between common-mode interference, so-called Y-interference, on the one hand, wherein the charge equalization is effected in phase by way of the mains power lines, and differential-mode interference, so-called X-interference, on the other hand, wherein the charge equalization is effected out of phase by way of the mains power lines.

In order to reduce conducted common-mode interference, current-compensated chokes are often used in the power input. In difficult cases this measure is however often not sufficient. A method for the active compensation of common-mode interference is known from EP 0 763 276 B1 which provides a further improvement. Based on the teaching of this publication, it is for example possible to generate a voltage opposite in phase to the high-frequency half-bridge voltage. Since both voltages couple capacitively into the environment, the interference caused thereby is compensated for on account of their opposite phasing. In particular in constant-current transformers, as are used in electronic ballasts according to the invention, this principle has however not been successfully applied hitherto because the generation of a voltage opposite in phase is possible only with a high resource requirement. In particular in the case of frequency components above 1 MHz, the compensation no longer functions satisfactorily because the currents involved are not arbitrarily phase-locked in consequence of the capacitances involved.

Particularly problematical is the already mentioned conducted common-mode interference in equipment belonging to protection class 2, which must observe the limit values of the relevant EMC regulations without a metallic housing and without a protective conductor connection. In contrast to this, in equipment having a metal housing an internal charge equalization up to a certain level is made possible by way of the metal housing.

SUMMARY

Various embodiments develop a electronic ballast in such a manner that it is distinguished by as little common-mode interference as possible, e.g. also when implemented without a metallic housing.

Various embodiments are based on the knowledge that different capacitances are responsible for the development of common-mode interference: A first capacitance is defined by the regions of the electronic ballast which are connected during operation to an HF voltage. As a result, a first voltage which is related to the external reference potential drops across this first capacitance during operation. In addition, a second capacitance is defined by the regions of the electronic ballast which during operation are supplied with a DC voltage HF-wise with respect to an internal reference potential. If the internal reference potential of the equipment can now be successfully changed in phase opposition to the interference source, in other words the voltage which drops across the first capacitance, then the common-mode interference can be reduced by this means, compensated for entirely in the ideal situation.

According to the invention, at least one component across which a second voltage which is opposite in phase to the first voltage drops during operation is therefore coupled between the internal and the external reference potential. In other words, in consequence of the first capacitance without this additional component, an HF current flowing across the first capacitance to the external reference potential is produced. This results in the aforementioned interference. If the circuit section, which without the additional component exhibits no interference with respect to the external reference potential, in other words the circuit section which is characterized by the second capacitance is now set up in such a manner by the insertion of the additional component that an HF current which is opposite in phase with respect to the HF current generated by the first capacitance flows to the external reference potential, then the aforementioned interference can be reduced or even eliminated. Only through the insertion of the additional component does the second capacitance therefore have an effect HF-wise. By means of the additional component, a voltage level difference is thus introduced with regard to the circuit section which without the additional component would be at a constant potential. In the present case this last-mentioned effect is utilized by means of appropriate design in order to reduce or even to compensate for the interference effect due to the first capacitance.

Through this measure, the quality of the interference suppression in particular also of equipment belonging to protection class 2 is significantly improved with a low resource requirement. On account of the greater distancing from the limit values of the relevant EMC standards, it is also possible to cope with installation situations which are critical in respect of interference suppression. For electronic ballasts which could previously only be used in lighting fixtures belonging to protection class 1, the field of application can be extended to equipment belonging to protection class 2.

In an advantageous embodiment, the at least one component is a compensation inductance. A particularly cost-effective implementation of the invention is thereby made possible.

By preference in this situation, the compensation inductance is chosen to be $L_k$=0.9 to 1.1*($L1*C_{hi}/C_{lo}$), whereby the compensation inductance is in particular chosen to be $L_k$=$L1*C_{hi}/C_{lo}$, where $C_{hi}$ represents the first capacitance, $C_{lo}$ the second capacitance, $L_k$ the compensation inductance and L1 the inductance of the converter throttle.

By preference, the compensation inductance amounts to the 0.01- to 0.9-fold inductance of the converter throttle. This results in a clear distinction from the current-compensated chokes known from the prior art which are based on a completely different principle. With regard to current-compensated chokes, the two chokes must namely have the same inductance in order to avoid being magnetized by the AC line current.

By particular preference, a snubber is coupled in parallel with the compensation inductance. By this means the compensation characteristics at very high frequencies, for example upwards of 5 MHz, can be improved. By preference in this situation, the snubber includes the series connection of a capacitor and an ohmic resistor.

By particular preference, the compensation inductance is coupled with the converter throttle. A magnetic coupling is thereby achieved, by means of which the electrical properties, in particular the frequency characteristics, of the two inductances are aligned. By particular preference in this situation, the compensation inductance is wound on the same core as the converter throttle.

Converter throttles frequently have an additional winding for detecting the demagnetization of the converter throttle. This results in the possibility of a particularly preferred embodiment of the present invention: in this case this additional winding constitutes the compensation inductance. As a result there is no need to use any additional inductance, which means that the winding structure is considerably simplified. Inductances which have been developed for use in constant-current transformers having an auxiliary winding for detecting the demagnetization can be taken over unchanged for implementation of the present invention. The implementation of the present invention can be effected solely through adaptation of the printed circuit board. In particularly preferred embodiments, the electronic ballast has no metallic housing and/or no protective conductor connection.

As already mentioned, the constant-current transformer can be a boost converter, whereby the converter diode is coupled serially between the converter throttle and the load circuit, whereby the connection point between the converter throttle and the converter diode is coupled by way of the converter switch with the internal reference potential.

Further preferred embodiments are set down in the subclaims.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
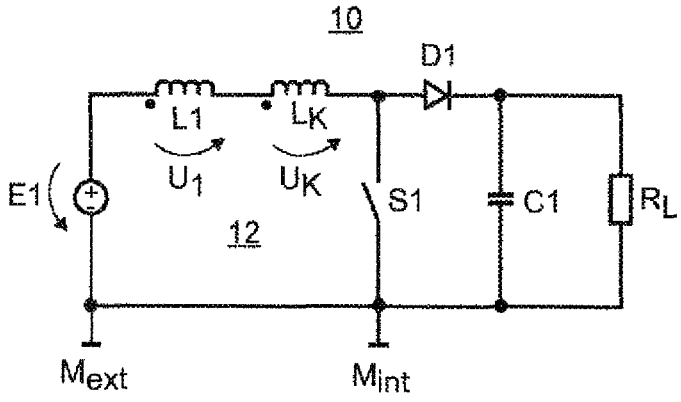
FIG. 1 shows a schematic illustration of a study of an electronic ballast.

FIG. 1 shows a schematic illustration of a study relating to the present invention by way of example of an electronic ballast having a constant-current transformer. The electronic ballast 10 is fed on the input side from a DC voltage source E1. In practice, the DC voltage source E1 can constitute an AC voltage source followed by a rectifier. The constant-current transformer 12 includes a converter throttle L1, a converter diode D1, and also a converter switch S1 which is activated by an activation circuit (not shown), as is known to the person skilled in the art from the prior art. Downstream of the converter throttle is arranged a storage capacitor C1, with which the load circuit $R_L$ is connected in parallel.

The negative pole of the DC voltage source E1 is coupled with an external reference potential $M_{ext}$, while the switch S1 of the constant-current transformer 12, the capacitance C1 and also the load circuit $R_L$ are coupled with an internal reference potential $M_{int}$.

In the present case, a compensation inductance $L_K$ is connected in series with the converter throttle L1. Assuming ideal components, the voltages present at the two inductances are exactly proportional to one another.

In the standard configuration of a buck or boost converter, L1 is coupled with the positive output of the voltage source E1. If the compensation inductance $L_K$ is now coupled serially with the converter throttle L1, then nothing is gained initially. Relative to the internal reference potential $M_{int}$ of the electronic ballast the voltages $U_1$ and $U_K$ present at the converter throttle L1 and the compensation inductance $L_K$ are in phase. Their amplitudes have the relationship $U_1/U_K$.

It is obvious that the currents through the converter throttle L1 and the compensation inductance $L_K$ at any point in time have the same amplitude and phase. Thus the time derivative of the current is also the same in both cases.

Figure 2:
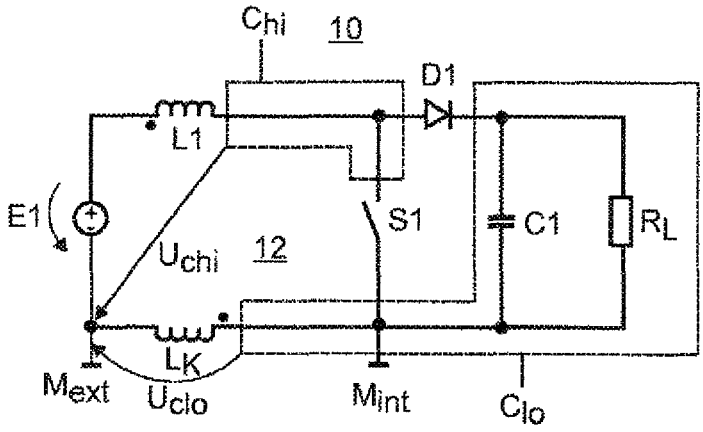
FIG. 2 shows a first exemplary embodiment of an electronic ballast according to the invention.

With reference to FIG. 2, the compensation inductance $L_K$ is now coupled between the external reference potential $M_{ext}$ and the internal reference potential $M_{int}$ in the case of a ballast according to the invention. With reference to the external reference potential $M_{ext}$, a voltage $U_{chi}$ drops across the converter throttle L1 and a voltage $U_{clo}$ drops across the compensation inductance $L_K$. When a positive edge occurs across the converter throttle L1, for example on switching off the converter switch S1, this results in a negative edge across the compensation inductance $L_K$. From the perspective of the external reference potential $M_{ext}$, the voltage level difference across the converter throttle L1 is therefore reduced.

As a matter of principle the connection between the converter throttle L1, the converter switch S1 and also the converter diode D1 is always kept as short as possible. The coupling capacitance to the environment is designated in the present instance by $C_{hi}$ and is therefore comparatively small. All the regions of the electronic ballast which are supplied with an HF voltage during operation of the electronic ballast thus contribute to the coupling capacitance $C_{hi}$.

On the other hand, all the components which during operation of the electronic ballast are supplied with a DC voltage HF-wise with respect to the internal reference potential $M_{int}$ contribute to a second coupling capacitance $C_{lo}$.

A complete compensation of the capacitive currents by the coupling capacitances $C_{hi}$ and $C_{lo}$ takes place when the following applies: $d/dt\ U_{chi}(t)*C_{hi}=d/dt\ U_{clo}(t)*C_{lo}$.

A complete compensation results from this when the compensation inductance $L_K$ is chosen as: $L_K=L1*C_{hi}/C_{lo}$.

Because the capacitance $C_{lo}$ is very much greater than $C_{hi}$, only a small voltage level difference $\Delta U_{Chi}$ is required for a compensation. This can be easily generated by using inductive components having a compact design or by means of an additional winding on the converter throttle L1.

Figure 3:
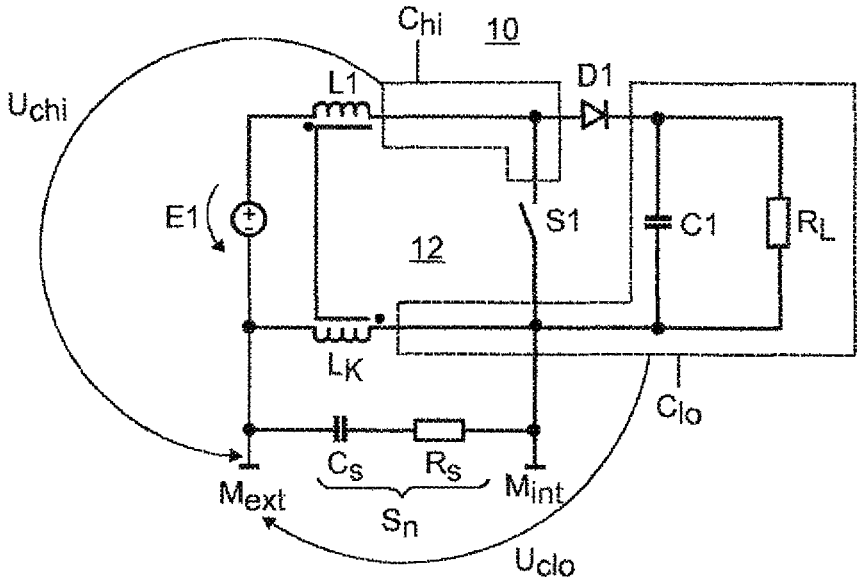
FIG. 3 shows a second exemplary embodiment of an electronic ballast according to the invention.

In the embodiment of a ballast according to the invention illustrated in FIG. 3 the coupling between the converter throttle L1 and the compensation inductance $L_K$ is indicated by the connecting line between these two inductances L1, $L_K$.

The embodiment illustrated in FIG. 3 moreover includes a snubber $S_n$ which for its part includes the series circuit of a capacitor $C_S$ and an ohmic resistor $R_S$ and is coupled in parallel with the inductance $L_K$. This snubber $S_n$ enables an improvement in the compensation at high frequency ranges, preferably upwards of 5 MHz.

In a preferred exemplary embodiment, the capacitance $C_S$ is 1.5 nF, the ohmic resistance $R_S$ is 6.8Ω.

The preceding description was based on ideal components. In reality however the inductances L1, $L_K$ have different parasitic parallel capacitances which prevent the complete compensation at higher frequencies. Depending on the desired degree of compensation, additional simple measures may therefore be necessary in order to bring about good interference suppression over the entire required frequency range. Commonly encountered for instance are capacitors, resistors or small ferrite beads which are connected in parallel or in series with the inductances L1, $L_K$, and also the switch S1 and the diode D1.

Figure 4:
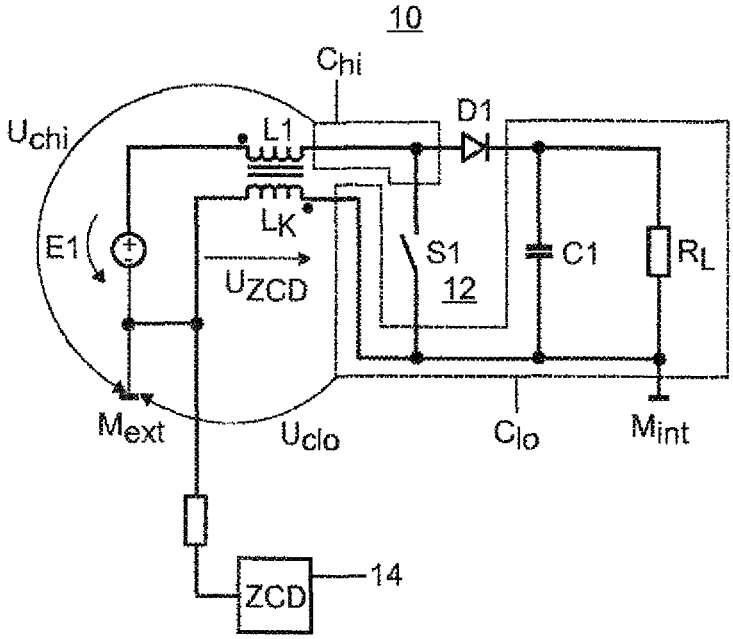
FIG. 4 shows a third exemplary embodiment of an electronic ballast according to the invention.

In the case of the embodiment illustrated in FIG. 4, the reference characters introduced with regard to FIG. 2 and FIG. 3 continue to apply insofar as they relate to the same or similar components. Merely the differences are explained. Here the compensation inductance $L_K$ is implemented by means of an auxiliary winding which normally serves for detecting the demagnetization of the converter throttle L1. For this purpose, the auxiliary winding $L_K$ is connected on the one hand to the internal reference potential $M_{int}$ and on the other hand to the external reference potential $M_{ext}$. Although the compensation inductance $L_K$ is used according to the invention, it can furthermore serve for detecting the demagnetization of the converter throttle L1. To this end, the voltage $U_{ZCD}$ dropping across the compensation inductance $L_K$ is coupled to the input ZCD of a corresponding control facility.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An electronic ballast for operating at least one discharge lamp, the electronic ballast comprising:

an input having a first and a second input connection for coupling to a DC supply voltage, whereby the second input connection is connected to an external reference potential;

a load circuit having an output having a first and a second output connection for connecting the at least one discharge lamp;

a constant-current transformer which comprises a converter throttle, a converter diode and a converter switch, whereby the converter throttle is coupled serially between the first input connection and the load circuit;

an activation circuit which is configured to activate the converter switch during operation with an HF signal;

whereby a first capacitance is defined by the regions of the electronic ballast which are connected during operation to an HF voltage, by means of which a first voltage is defined which during operation drops with respect to the external reference potential across the first capacitance; and whereby a second capacitance is defined by the regions of the electronic ballast which during operation are supplied with a DC voltage HF-wise with respect to an internal reference potential;

wherein at least one component across which a second voltage which is opposite in phase to the first voltage drops during operation is coupled between the internal and the external reference potential.

2. The electronic ballast as claimed in claim 1, wherein the at least one component is a compensation inductance.

3. The electronic ballast as claimed in claim 2, wherein the compensation inductance is chosen to be $L_k=0.9$ to $1.1*(L1*C_{hi}/C_{lo})$, where $C_{hi}$ represents the first capacitance, $C_{lo}$ the second capacitance, $L_k$ the compensation inductance, and L1 the inductance of the converter throttle.

4. The electronic ballast as claimed in claim 2, wherein the compensation inductance represents the 0.01- to 0.9-fold inductance of the converter throttle.

5. The electronic ballast as claimed in claim 2, wherein a snubber is coupled in parallel to the compensation inductance.

6. The electronic ballast as claimed in claim 5, wherein the snubber comprises the series connection of a capacitor and an ohmic resistor.

7. The electronic ballast as claimed in claim 2, wherein the compensation inductance is coupled with the converter throttle.

8. The electronic ballast as claimed in claim 7, wherein the compensation inductance is wound on the same core as the converter throttle.

9. The electronic ballast as claimed in claim 7, wherein the converter throttle has an additional winding for detecting the demagnetization of the converter throttle, whereby this additional winding constitutes the compensation inductance.

10. The electronic ballast as claimed in claim 3, wherein the compensation inductance is chosen to be $$L_k=L1*C_{hi}/C_{lo}.$$

11. The electronic ballast as claimed in claim 1, wherein the electronic ballast has no metallic housing.

12. The electronic ballast as claimed in claim 1, wherein the constant-current transformer is a boost converter, whereby the converter diode is coupled serially between the converter throttle and the load circuit, whereby the connection point between the converter throttle and the converter diode is coupled by way of the converter switch with the internal reference potential.

13. The electronic ballast as claimed in claim 1, wherein the electronic ballast has no protective conductor connection.

* * * * *